US011746517B2

(12) United States Patent
Kristjansson et al.

(10) Patent No.: US 11,746,517 B2
(45) Date of Patent: Sep. 5, 2023

(54) COUPLER FOR FLUIDICALLY COMMUNICATING A HOSE WITH A TRENCH DRAIN

(71) Applicant: Global Drain Technologies Inc., Winnipeg (CA)

(72) Inventors: Viking Kristjansson, Winnipeg (CA); Chad Kaatz, Winnipeg (CA); Henry Odiaz, Winnipeg (CA)

(73) Assignee: Global Drain Technologies Inc., Winnipeg (CA)

( * ) Notice: Subject to any disclaimer, the term of this patent is extended or adjusted under 35 U.S.C. 154(b) by 0 days.

(21) Appl. No.: 17/734,516

(22) Filed: May 2, 2022

(65) Prior Publication Data

US 2022/0356693 A1 Nov. 10, 2022

Related U.S. Application Data

(60) Provisional application No. 63/184,529, filed on May 5, 2021.

(51) Int. Cl.

| | |
|---|---|
| ***E01C 11/22*** | (2006.01) |
| ***E03F 5/04*** | (2006.01) |
| ***E03F 3/04*** | (2006.01) |
| *E02B 11/00* | (2006.01) |

(52) U.S. Cl.

CPC ..... *E03F 5/0402* (2013.01); *E03F 3/046* (2013.01); *E01C 11/22* (2013.01); *E02B 11/005* (2013.01); *E03F 5/04* (2013.01)

(58) Field of Classification Search

CPC ..... E02B 11/005; E03F 5/04; E01C 11/22

USPC ..... 405/39–45, 47–49; 404/2–5

See application file for complete search history.

(56) References Cited

U.S. PATENT DOCUMENTS

| | | | | |
|---|---|---|---|---|
| 5,564,857 | A * | 10/1996 | Schluter | E02B 11/005 405/36 |
| 5,908,266 | A * | 6/1999 | Miller | E01C 11/227 405/36 |
| 7,264,418 | B1 * | 9/2007 | Houck | E03F 3/046 405/47 |
| 2012/0321389 | A1 * | 12/2012 | Kreikemeier | E01C 11/221 405/48 |

FOREIGN PATENT DOCUMENTS

| | | | |
|---|---|---|---|
| EP | 1518964 | A1 * | 3/2005 |
| EP | 3075908 | A1 * | 10/2016 |
| GB | 2261242 | A * | 5/1993 |
| GB | 2566537 | A * | 3/2019 |

* cited by examiner

*Primary Examiner* — Sunil Singh
(74) *Attorney, Agent, or Firm* — Christopher J. Dynowski; Michael R. Williams; Ade & Company Inc.

(57) ABSTRACT

A fluidic coupler for fluidically communicating a hose with a trench drain in a support surface comprises a series of walls arranged to form a cavity and arranged for insertion into the trench drain, and a hose coupler supported on one of the walls for fluidically connecting a hose so that liquid discharged therefrom is released into the cavity. The cavity is open at the bottom of the fluidic coupler so as to release the liquid to the trench drain. The fluidic coupler includes stabilizing feet supported on opposite walls which are parallel to sidewalls of the trench drain. The feet include a pair of distinct feet located at spaced positions on a carrying one of the opposite walls, and on either side of the hose coupler.

10 Claims, 4 Drawing Sheets

COUPLER FOR FLUIDICALLY COMMUNICATING A HOSE WITH A TRENCH DRAIN

This application claims the benefit under 35 U.S.C. 119(e) of U.S. Provisional Application Ser. No. 63/184,529 filed May 5, 2021.

FIELD OF THE INVENTION

The present invention relates to a coupler for interconnecting a hose and a trench drain in a support surface which stands upwardly from the trench drain when fluidically coupled therewith.

BACKGROUND

In, for example, a distillery, brewery or winery, it is common to drain liquids from vessels onto a floor for subsequent gravity drainage along the floor to a drain therein that carries the liquid to waste or a collection basin. However, this process is clearly messy.

SUMMARY OF THE INVENTION

According to an aspect of the invention there is provided a coupler for fluidically communicating a hose with a trench drain in a support surface, the coupler comprising:

front and rear walls supported in upstanding generally-parallel spaced-apart condition, wherein the front and rear walls have upper portions defining tops thereof, lower portions defining bottoms thereof opposite to said tops, and laterally opposite sides spanning from the tops to the bottoms of the front and rear walls;

wherein the lower portions of the front and rear walls are configured for removable insertion into the trench drain in a working configuration of the fluidic coupler such that, in the working configuration, the upper portions of the front and rear walls are located externally of the trench drain;

a pair of side walls connected to the front and rear walls in spaced-apart condition and spanning between the front and rear walls to define a cavity therebetween;

a hose coupler supported on the upper portion of the front wall in fluidic communication with the cavity, and configured for fluidic coupling with the hose, so as to pass liquid from the hose to the cavity;

wherein the cavity is open at the bottoms of the front and rear walls for fluidic communication with the trench drain in the working configuration so as to release the liquid received from the hose to the trench drain; and a plurality of feet carried on the front and rear walls at spaced heights above the bottoms thereof and configured for resting on a top of the trench drain in the working configuration so as to support the hose coupler above the trench drain;

wherein the feet include a pair of distinct feet carried on one of the front and rear walls, defining a carrier wall, in laterally spaced-apart relation on either side of the hose coupler.

This arrangement provides a stably supported fluidic coupler for receiving liquid from a hose and guiding the same to the trench drain.

Typically, the trench drain comprises a channel embedded in support material forming the support surface and the channel extends longitudinally from one end, which may be closed, to a longitudinally opposite end of the channel, which may be in fluidic communication with a collection basin configured to collect liquid. Typically, the lower portions of the front and rear walls are configured for sliding movement along the channel.

Preferably, at least one of the distinct feet has a cut-out in a distal end thereof, which is opposite to the carrier wall, to form a plurality of toes.

Preferably, the pair of distinct feet are located at the sides of the carrier wall.

Preferably, at least one of the distinct feet comprises a drain-engaging portion arranged to face the top of the trench drain and projecting from the carrier wall to a distal end of the foot with an underside configured to engage the top of the drain, wherein the distal end is spaced from the carrier wall by a distance at least two times greater than a distance between outer surfaces of the front and rear walls.

In the illustrated arrangement, a peripheral edge of each of the distinct feet, which defines a footprint thereof, is rounded.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
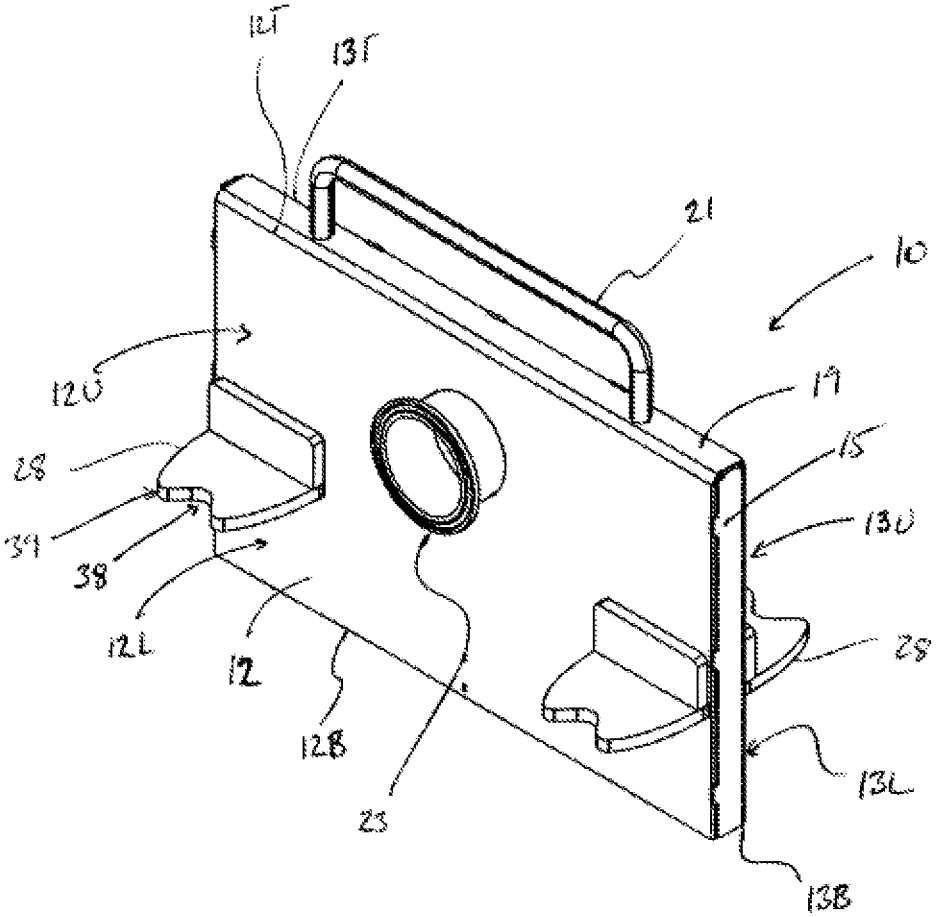
FIG. 1 is a perspective view of an arrangement of fluidic coupler according to the present invention.
Figure 2:
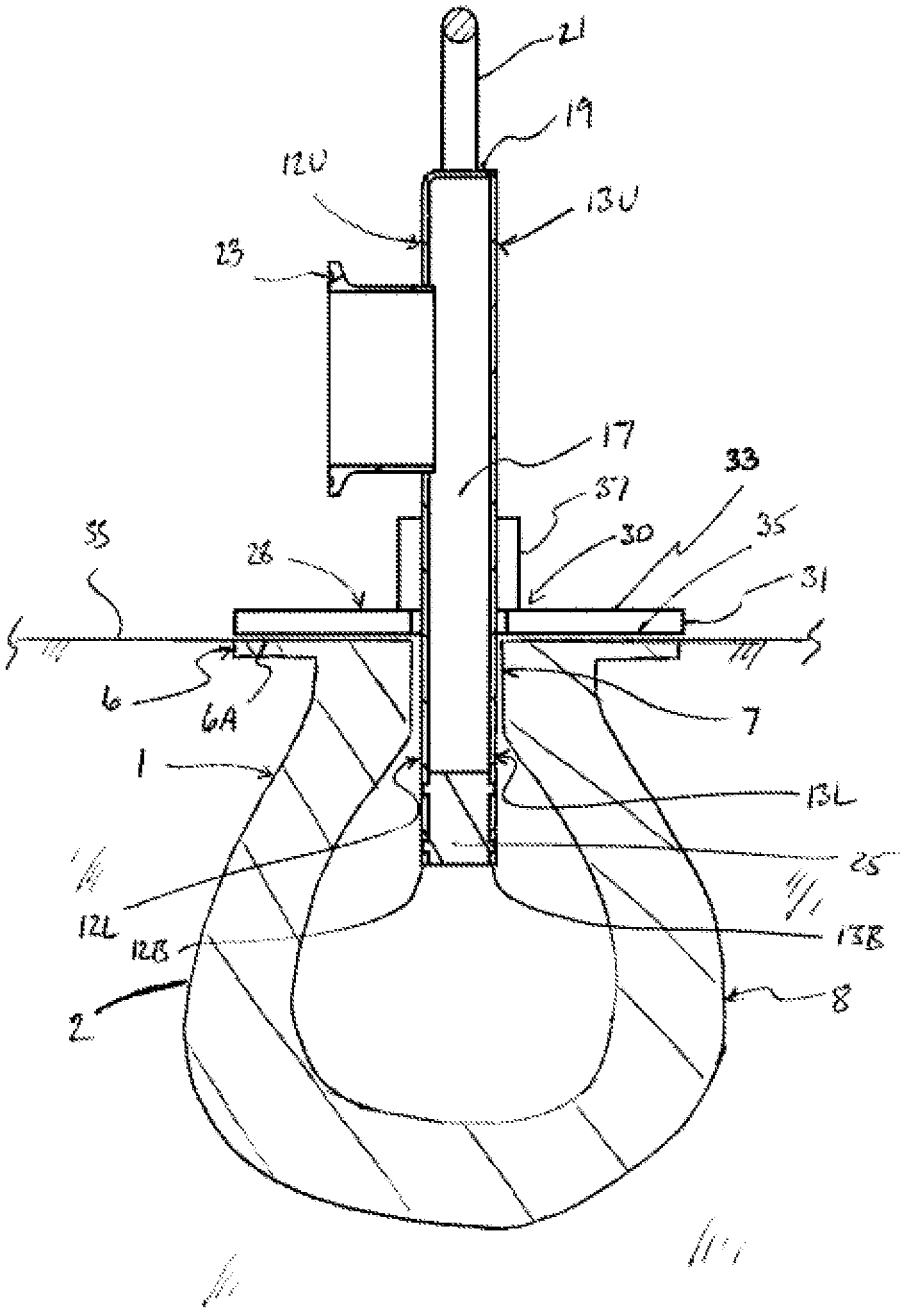
FIG. 2 is a cross-sectional view of the arrangement of FIG. 1 as if it were taken along line 2-2 in FIG. 3 but showing the fluidic coupler arrangement in use in a trench drain, which is schematically illustrated.
Figure 3:
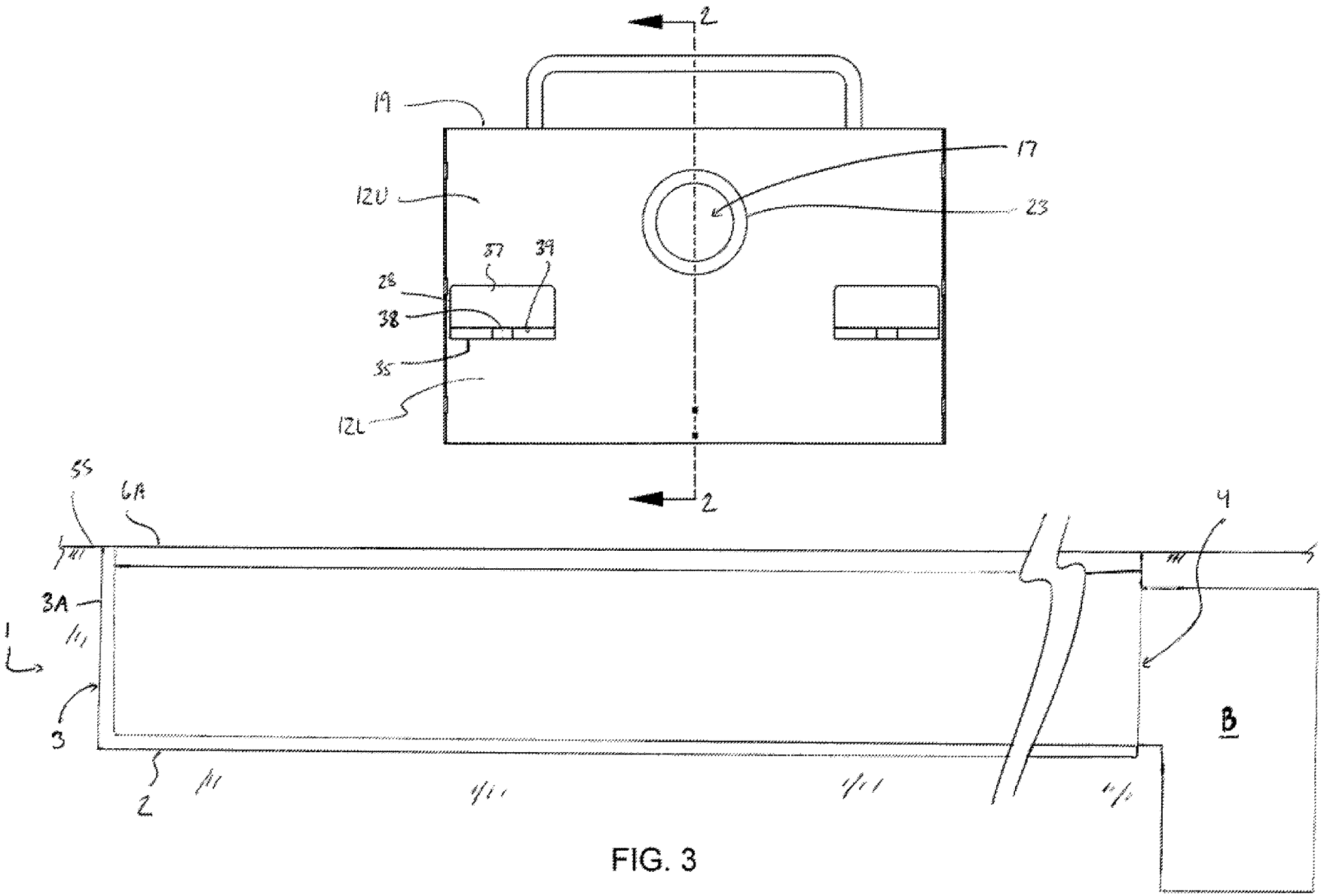
FIG. 3 is a front elevational view of the arrangement of FIG. 1 shown externally of the trench drain (schematically shown and with double sinusoidal break lines indicating truncated length)
Figure 4:
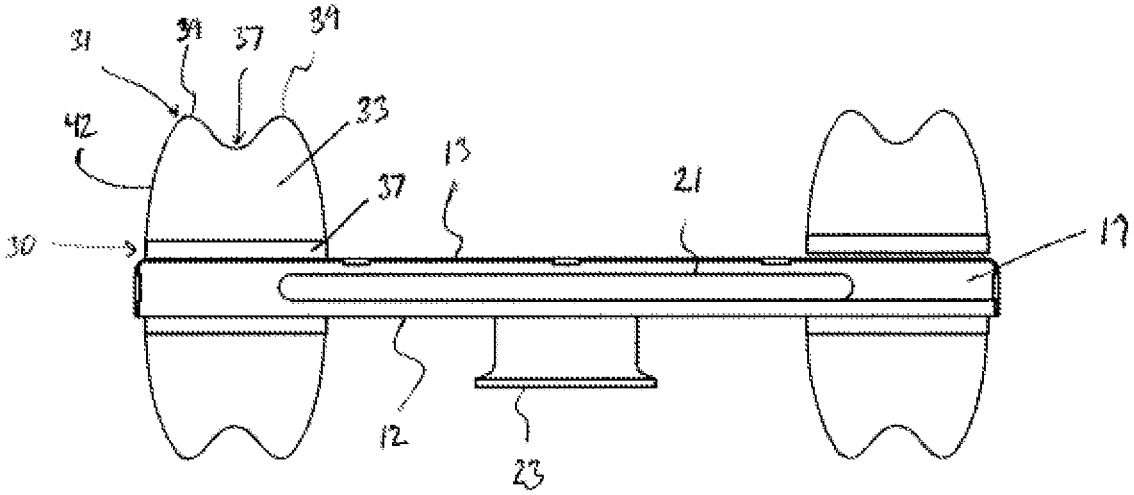
FIG. 4 is a top plan view of the arrangement of FIG. 1.

The accompanying figures show a fluidic coupler, indicated at reference numeral 10, for fluidically communicating a hose (not shown) with a trench drain 1 in a support surface SS, as more clearly shown in FIGS. 2 and 3. For example, the hose is fluidically connected to an outlet of a liquid-containing vessel (not shown) to guide the liquid as it flows out of the vessel. This is a typical configuration in an alcoholic-beverage production facility, such as a brewery, distillery or winery, in which used liquid contained in a vessel is to be discharged therefrom, after a production cycle, and into a drain in a support surface defined by a floor which collects waste liquid.

Generally speaking, the trench drain 1 is in the form of a channel or trough 2 which is embedded in support material forming or defining the support surface SS and which extends longitudinally from one end 3, which may be closed by wall 3A, to a longitudinally opposite end 4 of the channel, which may be in fluidic communication with a collection basin B which, with the drain 1 collectively forms a drainage system. In the illustrated arrangement, the collection basin B, which is configured to collect liquid, is disposed beneath the support surface. For example, the support surface SS may be a floor, when the drain is provided indoors, or the ground when the drain is installed outdoors.

The channel 2 comprises a upper visible portion 6 which is exposed at the support surface SS to define a top surface 6A of the channel, which in the illustrated arrangement is planar, and which is contiguous and preferably lies in a common plane as the surrounding support surface SS which typically also is planar. The upper channel portion 6 forms a longitudinally elongated slot 7 at the top of the channel which is relatively narrow so as to prevent passage of debris other than liquid into the trench drain. The upper portion 6 forms a mouth and throat of the trench drain which is configured to admit liquid into a lower conduit portion 8 thereof, which is enlarged relative to the slot in a transverse (width-wise) direction and which is configured to convey the liquid by gravity to waste. Typically, the channel 2 extends along a linear path such that the slot is linear, being elongated in the longitudinal direction of the channel.

The upper and lower portions of the channel are basically in the form of longitudinally extending sidewalls, which taper downwardly and outwardly to form a relatively narrow top inlet and an enlarged lower conduit, and which converge at a base at a base of the channel which is opposite the slot. In the illustrated arrangement, the upper and lower portions of the drain are integrally formed such that the drain is unitary.

Turning now to the fluidic coupler 10, this comprises front and rear walls 12, 13 supported in upstanding generally-parallel spaced-apart condition. The front and rear walls 12, 13 have upper portions 12U, 13U defining tops thereof indicated at 12T, 13T; lower portions 12L, 13L defining bottoms 12B, 13B thereof which are opposite to the tops 12T, 13T, and laterally opposite sides 12S, 13S spanning from the tops to the bottoms of the front and rear walls. In the illustrated arrangement, the front and rear walls 12, 13 are planar so as to each extend linearly from top to bottom and side to side.

The lower portions 12L, 13L of the front and rear walls are configured for removable insertion into the trench drain 1 in a working configuration of the fluidic coupler, which is more clearly shown in FIGS. 2 and 3, such that, in this configuration, the upper portions 12U, 13U of the front and rear walls are located externally of the trench drain. In the illustrated arrangement, the lower portions 12L, 13L are sized and shaped, primarily by spacing of the front and rear walls 12, 13, to be snugly inserted into the drain 1 through the slot 7 thereof, in a mating manner. In addition, since the drain slot 7 is linear, the lower portions 12L, 13L are configured for sliding movement along the channel.

Furthermore, the coupler 10 includes a pair of side walls 15 connected to the front and rear walls 12, 13 in spaced-apart condition and spanning between the front and rear walls to define a cavity 17 therebetween. More specifically, in the illustrated arrangement, the side walls 15 are arranged in upstanding, generally parallel and laterally spaced-apart condition between the front and rear walls, and are located at the sides 12S, 13S of the front and rear walls, so as to maximize a size of the cavity.

There is also provided a top wall 19 at or adjacent the tops 12T, 13T of the front and rear walls to close the cavity 17 from the top of the coupler 10. A handle 21 is attached to the top wall 19 and configured for gripping by a user to position the fluidic coupler in the working configuration.

Basically, the front, rear and side walls are a series of walls arranged to form a cavity, and thus the walls so connected form a container which is open at its bottom to an exterior environment of the fluidic coupler for gravitationally releasing liquid.

The fluidic coupler 10 further includes hose coupler 23 supported on the upper portion 12U of the front wall in fluidic communication with the cavity 17, and configured for fluidic coupling with the hose, so as to pass liquid from the hose to the cavity 17. As more clearly shown in FIG. 2, the liquid exiting the hose flows into the coupler in a generally normal direction of flow to the rear wall 13. The rear wall 13 thus deflects the liquid which is pulled by gravity towards the bottom of the fluidic coupler.

To enable the liquid received from the hose to exit the coupler, the cavity 17 is open at the bottoms 12B, 13B of the front and rear walls for fluidic communication with the trench drain 1 in the working configuration so as to release the liquid received from the hose to the trench drain. Thus the cavity is substantially enclosed except for at the bottom of the coupler for discharge of the liquid to the drain. One or more structural spacer members 25 are provided in the cavity 17 at or adjacent the bottoms of the front and rear walls to interconnect the walls, such that the interior cavity 17 of the coupler is communicated with the trench drain through one or more openings formed in the bottom of the coupler between the spacer members 25 and the walls 12, 13.

To support the fluidic coupler 10 in the working configuration, the coupler 10 includes a plurality of feet 28 carried on the front and rear walls 12, 13 at spaced heights above the bottoms thereof 12B, 13B and configured for resting on the top 6A of the trench drain in the working configuration so as to support the hose coupler 23 above the trench drain 1. Basically, the feet 28 define a depth of insertion of the coupler 10 into the drain and thus delimit the upper and lower portions of the front and rear walls.

The coupler feet 28 include a pair of distinct or separate feet carried on at least one of the front and rear walls 12, 13 in laterally spaced-apart relation on either side of the hose coupler 23. That is, the walls which are oriented to extend longitudinally of the trench drain are those which carry the feet. The feet act to stabilize a coupler body defining the cavity 17, which is collectively formed by at least the front and rear walls 12, 13 and the side walls 15, against impact of liquid on the walls of the coupler as the liquid flows into and out of the cavity, which may induce fore-and-aft and side-to-side movement of the coupler 10. It will be appreciated that the wall receiving the distinct feet may be referred to as a carrier wall for the feet for convenient reference.

In the illustrated arrangement, the coupler feet include a second pair of distinct feet carried on the other one of the front and rear walls, such that both the front and rear walls 12, 13 which face outwardly and are located adjacent opposite sides of the upper channel portion 6, for enhanced stabilization.

The pairs of distinct feet 28 are located at the sides the carrier wall so that they are arranged at maximally spaced apart positions on the wall. That is, the feet 28 are disposed at lateral terminuses of the front and rear walls 12, 13.

Each foot 28 comprises a proximal end 30, relative to the carrier wall, which is at or adjacent the same, and which may be connected to the carrier wall so as to mount the foot thereto. The foot extends outwardly from the proximal end 30 in a transverse direction to the carrier wall to a distal end 31 thereof, which is spaced from the carrier wall.

At least one, and preferably each, of the distinct feet comprises a drain-engaging portion 33 arranged to face the top of the trench drain, defined by the top surface 6A, and projecting from the carrier wall to the distal end 31 defined by the drain-engaging portion with an underside 35 configured to engage the top of the drain. In the illustrated arrangement, the drain-engaging portion 33 is planar so as to provide a planar underside for butting engagement with a planar top surface of the drain 1.

Additionally, each distinct foot 28 comprises a bracing portion 37 thereof which is in fixed relation to the drain-engaging portion and provides an inner mounting surface for attaching to the carrier wall. In the illustrated arrangement, the bracing portion 37 is planar and arranged parallel to the carrier wall to provide a maximum sized mounting surface. Also, the bracing and drain-engaging portions 37, 33 are integrally formed in the illustrated arrangement.

The distal end 31 of at least one, and preferably each, foot is spaced from the carrier wall by a distance at least two times greater than a distance between outer surfaces of the front and rear wall, which are positioned for engagement with an interior of the drain as shown in FIG. 2.

At least one, and preferably each, of the distinct feet 28 has a cut-out 38 37 in the distal end 31 thereof, which is opposite to the carrier wall, to form a plurality of toes 39. The cut-out 38 extends partially inwardly, towards the carrier wall, less than half of a depth of the foot from the wall or proximal end 30 of the foot to the distal end 31 thereof.

In the illustrated arrangement, a peripheral edge 42 of each of the distinct feet, which defines a footprint thereof, is rounded. Thus, each toe is rounded and the cut-out 38 is concavely rounded.

As described hereinbefore, the present invention relates to a fluidic coupler for fluidically communicating a hose with a trench drain in a support surface, which comprises a series of walls arranged to form a cavity and arranged for insertion into the trench drain, and a hose coupler supported on one of the walls for fluidically connecting a hose so that liquid discharged therefrom is released into the cavity. The cavity is open at the bottom of the fluidic coupler so as to release the liquid to the trench drain. The fluidic coupler includes stabilizing feet supported on opposite walls which are parallel to sidewalls of the trench drain. The feet include a pair of distinct feet located at spaced positions on a carrying one of the opposite walls, and on either side of the hose coupler.

This arrangement provides a stably supported fluidic coupler for receiving liquid from a hose and guiding the same to the trench drain.

In use, the fluidic coupler 10 is manually inserted into the trench drain 1 with its bottom, defined by the lower portions 12L, 13L oriented downwardly and located in the slot 7 of the drain, so as to arrange the coupler 10 in the working configuration. As such, the fluidic coupler stands upwardly from the trench drain, and it is positioned with its bottom projecting into the channel 2 so that the coupler cavity 17 is positioned in communication with the drain at an inwardly spaced position from the slot 7 and top of the drain.

With a hose fluidically connected to the fluidic coupler 10 via the hose coupler 23, liquid is discharged from the hose and into the coupler's cavity 17, which gravitationally directs the liquid downwardly and into the trench drain. More generally speaking, liquid received from the hose is conveyed by the fluidic coupler to the drain.

The fluidic coupler is slidably repositionable along the length of the trench drain by sliding movement along the slot 7.

The scope of the claims should not be limited by the preferred embodiments set forth in the examples but should be given the broadest interpretation consistent with the specification as a whole.

The invention claimed is:

1. A system for draining liquid from a vessel using a hose fluidically communicated therewith, the system comprising:

a trench drain in a support surface for receiving the liquid conveyed by the hose, wherein the trench drain comprises:

a channel arranged in a support material underlying the support surface, wherein the channel includes an upper portion defining a top of the trench drain arranged to be exposed at the support surface and a lower portion of the channel forming a base of the channel;

wherein the upper portion forms, at the top of the trench drain, a slot-shaped opening which is longitudinally elongated and defines an inlet for passage of the liquid into the trench drain;

wherein the lower portion has an interior which is enlarged in a transverse direction relative to the inlet; and a fluidic coupler for fluidically communicating the hose with the trench drain, wherein the coupler comprises:

front and rear walls supported in upstanding generally-parallel spaced-apart condition, wherein the front and rear walls have upper portions defining tops thereof, lower portions defining bottoms thereof opposite to said tops, and laterally opposite sides spanning from the tops to the bottoms of the front and rear walls;

wherein the lower portions of the front and rear walls are removably inserted through the slot-shaped opening of the trench drain and into the channel thereof in a working configuration of the fluidic coupler such that, in the working configuration, the bottoms of the front and rear walls are in the channel, below the slot-shaped opening, and the upper portions of the front and rear walls are located externally of and above the trench drain;

a pair of side walls connected to the front and rear walls in spaced-apart condition and spanning between the front and rear walls to define a cavity therebetween;

a hose coupler supported on the upper portion of the front wall in fluidic communication with the cavity, and configured for fluidic coupling with the hose, so as to pass liquid from the hose to the cavity;

wherein the cavity is open at the bottoms of the front and rear walls for fluidic communication with the channel in the working configuration so as to release the liquid received from the hose to the trench drain; and a plurality of feet carried on the front and rear walls at spaced heights above the bottoms thereof and configured for resting on the top of the upper portion of the trench drain in the working configuration so as to support the hose coupler above and outside the trench drain;

wherein the plurality of feet include a pair of distinct feet carried on one of the front and rear walls, defining a carrier wall, in laterally spaced-apart relation on either side of the hose coupler;

wherein the plurality of feet comprise drain-engaging portions arranged to face and engage the top of the trench drain and projecting from a respective one of the front and rear walls outwardly from the front and rear walls, wherein the drain-engaging portions are disposed above the bottoms of the front and rear walls; and wherein the hose coupler is disposed above the plurality of feet.

2. The coupler of claim 1 wherein at least one of the pair of distinct feet has a cut-out in a distal end thereof, which is opposite to the carrier wall, to form a plurality of toes.

3. The coupler of claim 1 wherein the pair of distinct feet are located at the laterally opposite sides of the carrier wall.

4. The coupler of claim 1 wherein a distal end of at least one of the pair of distinct feet is spaced from the carrier wall by a distance at least two times greater than a distance between outer surfaces of the front and rear walls.

5. The system of claim 1 wherein a peripheral edge of each of the pair of distinct feet, which defines a footprint thereof, is rounded.

6. The system of claim 1 wherein the lower portions of the front and rear walls are removably slidably inserted into the trench drain such that the coupler is slidably movable along the slot-shaped opening in a longitudinal direction relative to the trench drain.

7. A coupler for fluidically communicating a hose with a trench drain in a support surface, the coupler comprising:

front and rear walls supported in upstanding generally-parallel spaced-apart condition, wherein the front and rear walls have upper portions defining tops thereof, lower portions defining bottoms thereof opposite to said tops, and laterally opposite sides spanning from the tops to the bottoms of the front and rear walls;

wherein the lower portions of the front and rear walls are configured for removable insertion into the trench drain in a working configuration of the fluidic coupler such that, in the working configuration, the upper portions of the front and rear walls are located externally of the trench drain;

a pair of side walls connected to the front and rear walls in spaced-apart condition and spanning between the front and rear walls to define a cavity therebetween;

a hose coupler supported on the upper portion of the front wall in fluidic communication with the cavity, and configured for fluidic coupling with the hose, so as to pass liquid from the hose to the cavity;

wherein the cavity is open at the bottoms of the front and rear walls for fluidic communication with the trench drain in the working configuration so as to release the liquid received from the hose to the trench drain; and a plurality of feet carried on the front and rear walls at spaced heights above the bottoms thereof and configured for resting on a top of the trench drain in the working configuration so as to support the hose coupler above the trench drain;

wherein the plurality of feet include a pair of distinct feet carried on one of the front and rear walls, defining a carrier wall, in laterally spaced-apart relation on either side of the hose coupler;

wherein at least one of the pair of distinct feet has a cut-out in a distal end thereof, which is opposite to the carrier wall, to form a plurality of toes.

8. The coupler of claim 7 wherein the pair of distinct feet are located at the laterally opposite sides of the carrier wall.

9. The coupler of claim 7 wherein at least one of the pair of distinct feet comprises a drain-engaging portion arranged to face the top of the trench drain and projecting from the carrier wall to a distal end of said at least one of the pair of distinct feet with an underside configured to engage the top of the drain, wherein the distal end is spaced from the carrier wall by a distance at least two times greater than a distance between outer surfaces of the front and rear walls.

10. The coupler of claim 7 wherein a peripheral edge of each of the pair of distinct feet, which defines a footprint thereof, is rounded.

* * * * *